US006470605B1

(12) United States Patent
Gilman et al.

(10) Patent No.: US 6,470,605 B1
(45) Date of Patent: Oct. 29, 2002

(54) EARTH REDUCTION TOOL

(76) Inventors: John William Gilman, 305 Water Mill Rd., Greer, SC (US) 29650; Edward Kennedy, 22460 SE. 216th Pl., Maple Valley, WA (US) 98038

( * ) Notice: Subject to any disclaimer, the term of this patent is extended or adjusted under 35 U.S.C. 154(b) by 0 days.

(21) Appl. No.: 09/714,609

(22) Filed: Nov. 16, 2000

Related U.S. Application Data

(60) Provisional application No. 60/165,795, filed on Nov. 16, 1999, provisional application No. 60/165,677, filed on Nov. 16, 1999, and provisional application No. 60/200,460, filed on Apr. 28, 2000.

(51) Int. Cl.[7] ..... E02F 3/88
(52) U.S. Cl. ..... 37/323
(58) Field of Search ..... 37/317, 322, 323, 37/318, 321, 195; 175/66, 67, 424; 406/88, 96, 157–162; 405/163

(56) References Cited

U.S. PATENT DOCUMENTS

| | | | | |
|---|---|---|---|---|
| 4,936,031 A | | 6/1990 | Briggs et al. | 37/80 R |
| 4,991,321 A | | 2/1991 | Artzberger | 37/62 |
| 5,016,717 A | | 5/1991 | Simons et al. | 175/66 |
| 5,140,759 A | | 8/1992 | Artzberger | 37/80 R |
| 5,295,317 A | | 3/1994 | Perrott | 37/348 |
| 5,299,370 A | | 4/1994 | Gyori et al. | 37/347 |
| 5,408,766 A | | 4/1995 | Pobihushchy | 37/323 |
| 5,860,232 A | | 1/1999 | Nathenson et al. | 37/466 |
| 5,901,478 A | * | 5/1999 | Sawyer, Jr. | 37/323 |
| 6,000,151 A | * | 12/1999 | Hayes | 37/323 |
| 6,145,223 A | * | 11/2000 | Flesen | 37/317 |

* cited by examiner

*Primary Examiner*—Robert E. Pezzuto
(74) *Attorney, Agent, or Firm*—Leatherwood Walker Todd & Mann, P.C.

(57) ABSTRACT

A reduction system using water pressure and vacuum excavation and including a water supply tank, water pump, vacuum pump, slurry collection tank, a system for tilting the collection tank, handheld reduction tool, and a drive system. The reduction tool, or wand, is used to deliver high pressure fluid, such as water, to the ground in order to loosen soil directly in front of the tool. The tool includes diametrically opposed nozzles which are angled with respect to one another such that pressurized water delivered from the nozzles is directed in a fashion to slice the ground in a generally spiral or helical fashion as the tool is pressed downward into the ground. As the soil is loosened by the pressurized water delivered from the nozzles, the loosened soil is sucked away to form a hole in the ground, and such loosened soil (a slurry when mixed with the water) passes upwardly through the tool in a vacuum air-flow created by the vacuum pump and is deposited in the slurry collection tank.

38 Claims, 9 Drawing Sheets

EARTH REDUCTION TOOL

This application claims benefit of U.S. Provisional Application Nos. 60/165,795, filed Nov. 16, 1999; No. 60/165,677, filed Nov. 16, 1999; and No. 60/200,460, filed Apr. 28, 2000, the entirety of the disclosures of the foregoing applications being incorporated herein be reference thereto.

BACKGROUND OF THE INVENTION

This invention relates generally to a reduction system for removing soil in order to expose underground utilities (such as electrical and cable services, water and sewage services, etc.) and also for removing other materials from the ground or other surfaces for cleanup or remediation purposes.

With the increased use of underground utilities, it has become more critical to locate and verify the placement of buried utilities before installation of additional underground utilities or before other excavation or digging work is performed. Conventional digging and excavation methods such as shovels, post hole diggers, powered excavators, backhoes, etc., may be limited in their use in locating buried utilities as they may tend to cut, break, or otherwise damage the utilities during use of such digging devices.

Electronic devices are known which can be used to locate buried utilities with a certain degree of accuracy, one of such devices being the VERIFIER®, manufactured by McLaughlin Manufacturing Company of Greenville, S.C. In using this device, an operator walks on the ground while holding the locating device, which signals when it finds a buried utility. The operator can then mark the ground at that point, but ordinarily, an actual viewing of the buried utility is required for confirmation. This requires digging up the soil manually, such as with a shovel or post hole digger, or using some powered digging means.

Devices have been developed which create holes in the ground to non-destructively expose and allow the actual bare underground utilities to be viewed. One design uses high pressure air delivered through a reduction tool, or wand, in order to loosen soil to form a hole, and includes a vacuum system to vacuum away the dirt as the dirt is loosened. Another system uses high pressure water delivered by a wand to soften the soil and create a soil/water slurry mixture. The wand is provided with a vacuum system for vacuuming the slurry away.

In addition to boring holes in the ground in a non-destructive manner, these devices may also be used for removing drilling mud, such as bentonite drilling fluid, which may leak out to the ground surface during well installations or other excavation operations. Otherwise, the bentonite could remain as an unsightly and undesirable coating on lawns and other ground coverings. Apart from vacuuming bentonite, the devices could be used to vacuum mud or other spoil from the ground, which could be byproducts of excavation or drilling operations, or, perhaps, flooding or spills.

One such device which uses water and a vacuum system is disclosed in U.S. Pat. No. 5,295,317, issued to Perrott. U.S. Pat. No. 5,408,766, issued to Pobihushchy, discloses an excavator having a cutting tool pipe with nozzles for delivering high pressure water. The vacuum is drawn through a hose, with the water and displaced soil being drawn away into a holding tank.

U.S. Pat. No. 5,140,759, issued Artzberger, discloses a pneumatic excavator having nozzles associated with a housing and conduit. Another pressurized air device is disclosed in U.S. Pat. No. 4,936,031, issued to Briggs, et al., which discloses an excavator having air nozzles extending downwardly from a digging head, which rotates during use. A suction unit is also provided.

While the foregoing designs are known, there still exists a need for a device having improved reduction capabilities.

SUMMARY OF THE INVENTION

It is, therefore, the principal object of this invention to provide a reduction system.

Another object of the present invention is to provide a soil reduction system for excavating or removing soil in order to dig a hole.

Another object of the present invention is to provide a reduction system for moving materials such as snow, mud, grain, from one location to another.

Yet another object of the present invention is to provide a reduction system for use in rescue operations for removing persons trapped or buried beneath soil, snow, mud, grain, or some other substance.

Still another object of the present invention is to provide a reduction system for removing materials from the surface of the ground.

Another object of the present invention is to provide a reduction system having an improved fluid nozzle configuration.

Still another object of the present invention is to provide a reduction system having means for automatically cleaning a holding tank.

Yet another object of the present invention is to provide a reduction system having a reduction tool which can be readily extended in length.

A further object of the present invention is to provide a reduction system having a reduction tool with control means associated with the handle for controlling nozzle fluid flow and/or vacuuming action of the reduction tool.

Another object of the present invention is to provide a reduction system having nozzles in a reduction tool configured for providing a spiral cutting action.

Yet another object of the present invention is to provide a reduction system having an automatic shut-off feature upon filling of a slurry, or spoil, accumulation tank.

Yet another object of the present invention is to provide a reduction system having an automatic shut-off feature upon the level of water in a fluid supply tank falling below a predetermined level.

A further object of the present invention is to provide a method for removing soil or other matter from ground surface.

Another object of the present invention is to provide a method for cleaning an accumulation tank of a reduction device.

Generally, the present invention includes a reduction system using water pressure and vacuum excavation and includes a water supply tank, water pump, vacuum pump, slurry collection tank, means for tilting the collection tank, handheld reduction tool, and drive means.

The reduction tool, or wand, is used to deliver high pressure fluid, such as water, to the ground in order to loosen soil directly in front of the tool. The tool includes diametrically opposed nozzles which are angled with respect to one another such that pressurized water delivered from the nozzles is directed in a fashion to slice the ground in a generally spiral or helical fashion as the tool is pressed downward into the ground.

As the soil is loosened by the pressurized water delivered from the nozzles, the loosened soil is sucked away to form a hole in the ground, and such loosened soil (a slurry when mixed with the water) passes upwardly through the tool in a vacuum air-flow created by the vacuum pump. This slurry is ultimately deposited in the slurry collection tank.

To assist in the suctioning of the soil/water, or slurry, mixture from the hole, the tool is provided with air inlets which allow for the suction air-flow to sweep around the dirt and hole being cut with the tool.

The present invention also includes a single water line extending the length of the tool and terminating in a generally C-shaped manifold, to which the nozzles are attached. The C-shaped manifold is located on the interior of the reduction tool rather than on the exterior, thereby providing protection to the manifold from damage as the tool is being used.

A control valve is incorporated into a handle provided on the reduction tool, and the control valve is used to activate or deactivate the pressurized water nozzles as necessary.

The end of the reduction tool opposite the end having the nozzles is provided with connection means, such as quick release clamps, or banjo clips, which allow additional tool extension sections to be attached to effectively lengthen the tool, to thereby allow for digging deeper holes.

The reduction system of the present invention also includes an automatic tank clean out feature provided in the slurry collection tank. The slurry collection tank is used for storing the slurry, or spoil, or other material vacuumed up by the tool. When the slurry collection tank becomes full, an automatic system is provided which automatically shuts down the vacuum system. This prevents the slurry mixture from being drawn into the vacuum pump.

When it becomes necessary to empty the slurry collection tank, the liquid contents can be drained through a valve, such as a gate valve provided in the door of the tank. However, in order to remove solids which remain in the tank, a series of nozzles, such as fan nozzles, are provided which are connected to a water supply pipe running axially through the tank. These fan nozzles can then be actuated to deliver high pressure water to clean the tank, without requiring the operator to use a water hose or to resort to manual cleaning.

The axially running pipe includes a threaded male end which is received within a female fitting attached to a screw-down door handle provided on a door for the collection tank. The axial tube thus performs not only as a conduit for delivering water to the fan nozzles used to clean the tank, but also acts as a structural member against which the collection tank door is pulled when the door handle is turned, to an adjustable preset seat, for tightly sealing the door.

A reservoir water tank is provided with the system as a reservoir for supplying water to the nozzles.

The reduction system of the present invention can also be used for material handling purposes for transporting granular or particular matter, such as sand, soil, grain, or other substance from one location to another, namely, the accumulation tank. In such operations, the reduction system may be used with or without the water nozzle feature discussed above.

The reduction system of the present invention may also find use in rescue operations for buried or trapped persons. For example, the system could potentially be used for removing snow in order to locate or provide breathing passages for persons buried by an avalanche. It could also be used to remove or assist persons buried by earthquakes, landslides, mudslides, in grain elevators or in other farm or industrial situations. Additionally, it could be used to recover the bodies in a generally non-destructive manner of those who have perished in the foregoing situations.

BRIEF DESCRIPTION OF THE DRAWINGS

The foregoing, as well as other objects of the present invention, will be further apparent from the following detailed description of the preferred embodiment of the invention, when taken together with the accompanying specification and the drawings, in which.

DESCRIPTION OF THE PREFERRED EMBODIMENT

Figure 1:
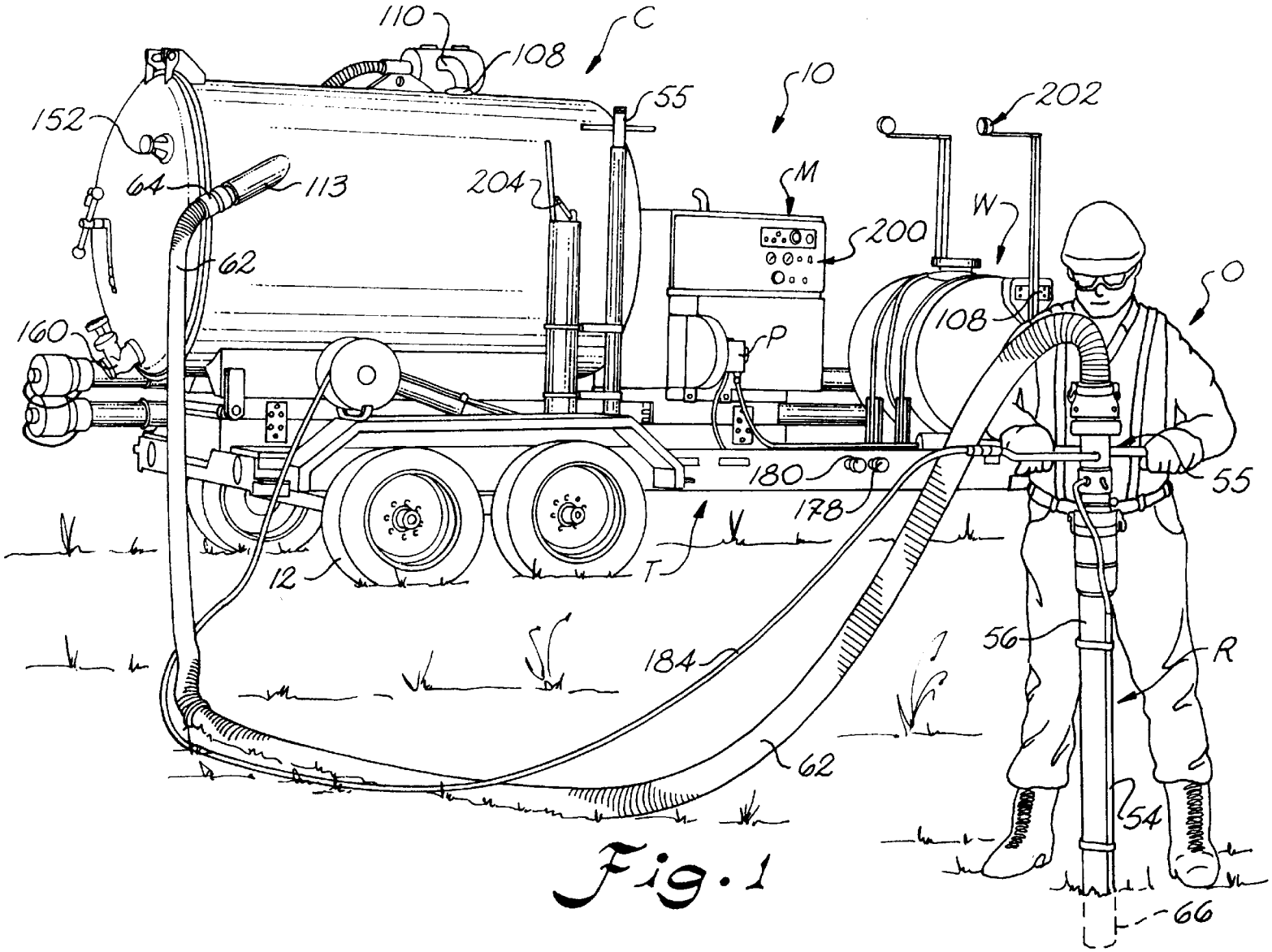
FIG. 1 is a perspective view of the reduction system constructed in accordance with the present invention.

The accompanying drawings and the description which follows set forth this invention in its preferred embodiment. However, it is contemplated that persons generally familiar with soil reduction equipment will be able to apply the novel characteristics of the structures illustrated and described herein in other contexts by modification of certain details. Accordingly, the drawings and description are not to be taken as restrictive on the scope of this invention, but are to be understood as broad and general teachings.

Referring now to the drawings in detail, wherein like reference characters represent like elements or features throughout the various views, the reduction system of the present invention is indicated generally in the figures by reference character 10.

Figure 11:
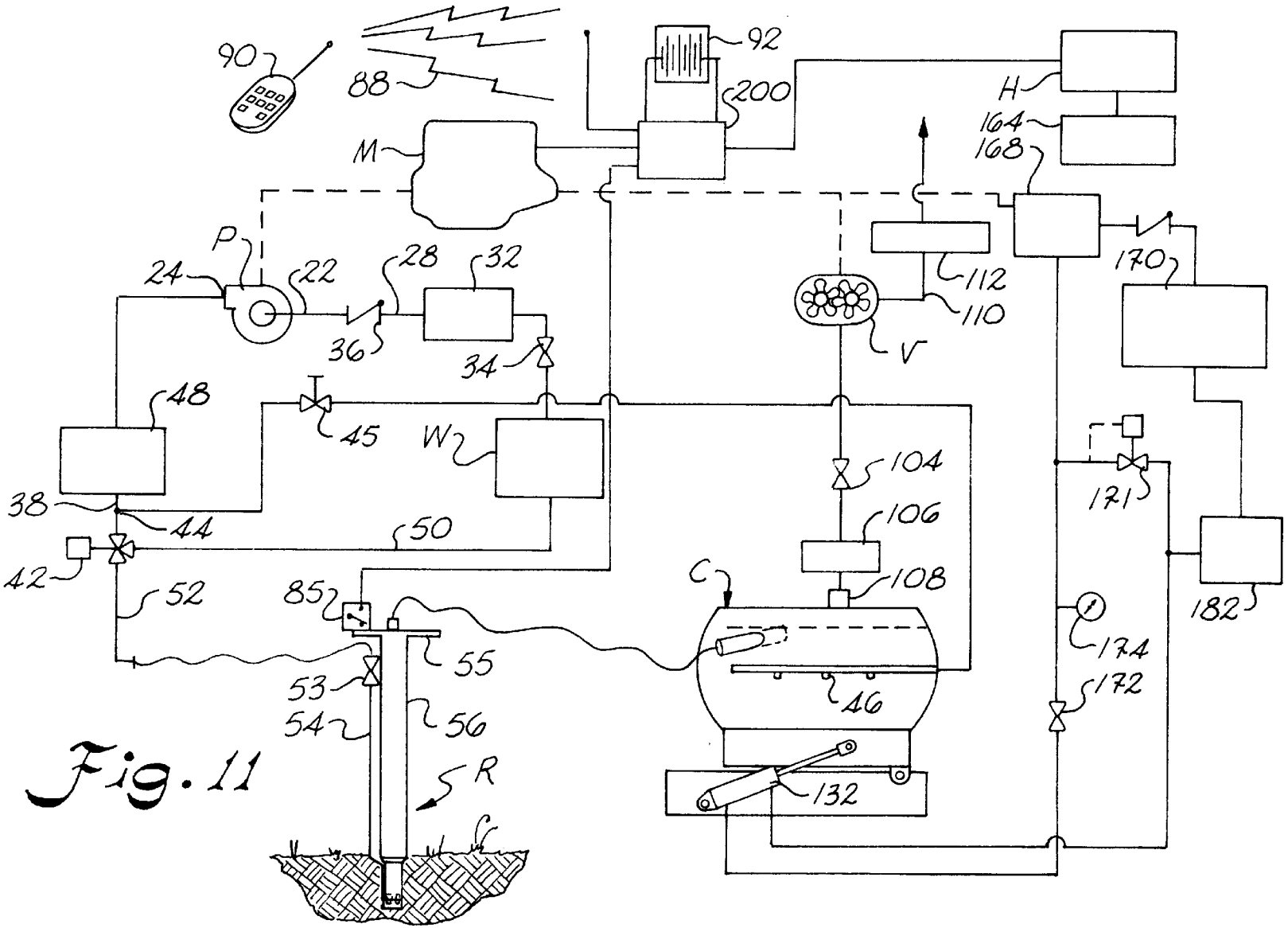
FIG. 11 is a schematic view of the hydraulic, water, and vacuum systems of the reduction system.

Turning to FIG. 1, reduction system 10 includes a trailer, generally T, on which a water reservoir tank, generally W, is mounted. Water reservoir W is connected to a water pump, generally P, which is driven by a motor, generally M. Motor M also drives a vacuum pump, generally V (FIG. 6) and provides through its electrical system electrical power for driving an electric hydraulic pump, generally H (FIG. 11). Vacuum pump V and water pump P are both connected to a reduction tool, generally R, which is the actual remediation tool worked by an operator, generally (FIG. 1). Also mounted on trailer T is a slurry, or spoil, collection tank, generally C, which is also connected to vacuum pump V, with vacuum pump V drawing a vacuum through collection tank C and reduction tool R during use of reduction system 10.

Figure 2:
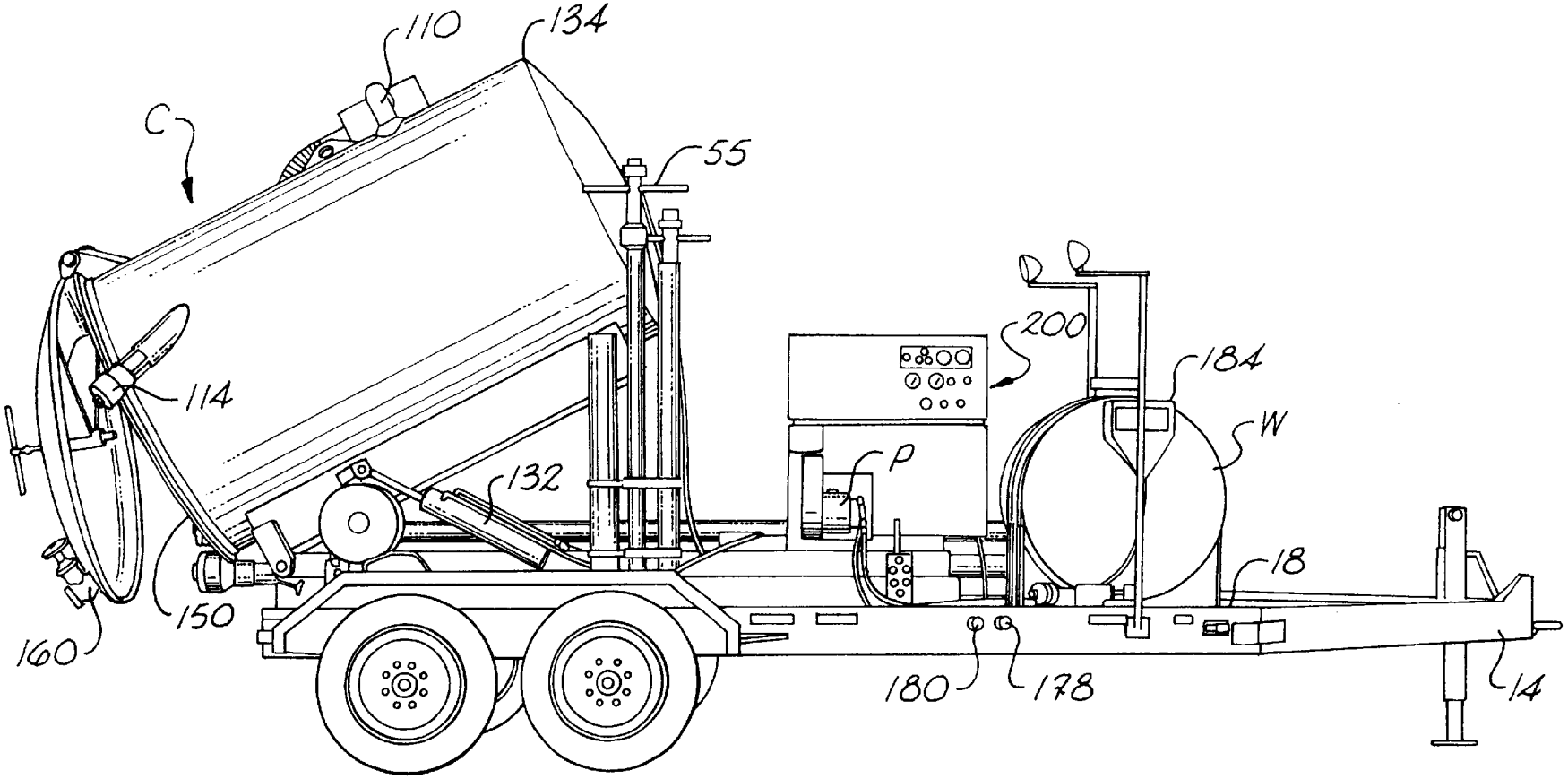
FIG. 2 is a side elevational view of a reduction system constructed in accordance with the present invention.
Figure 3:
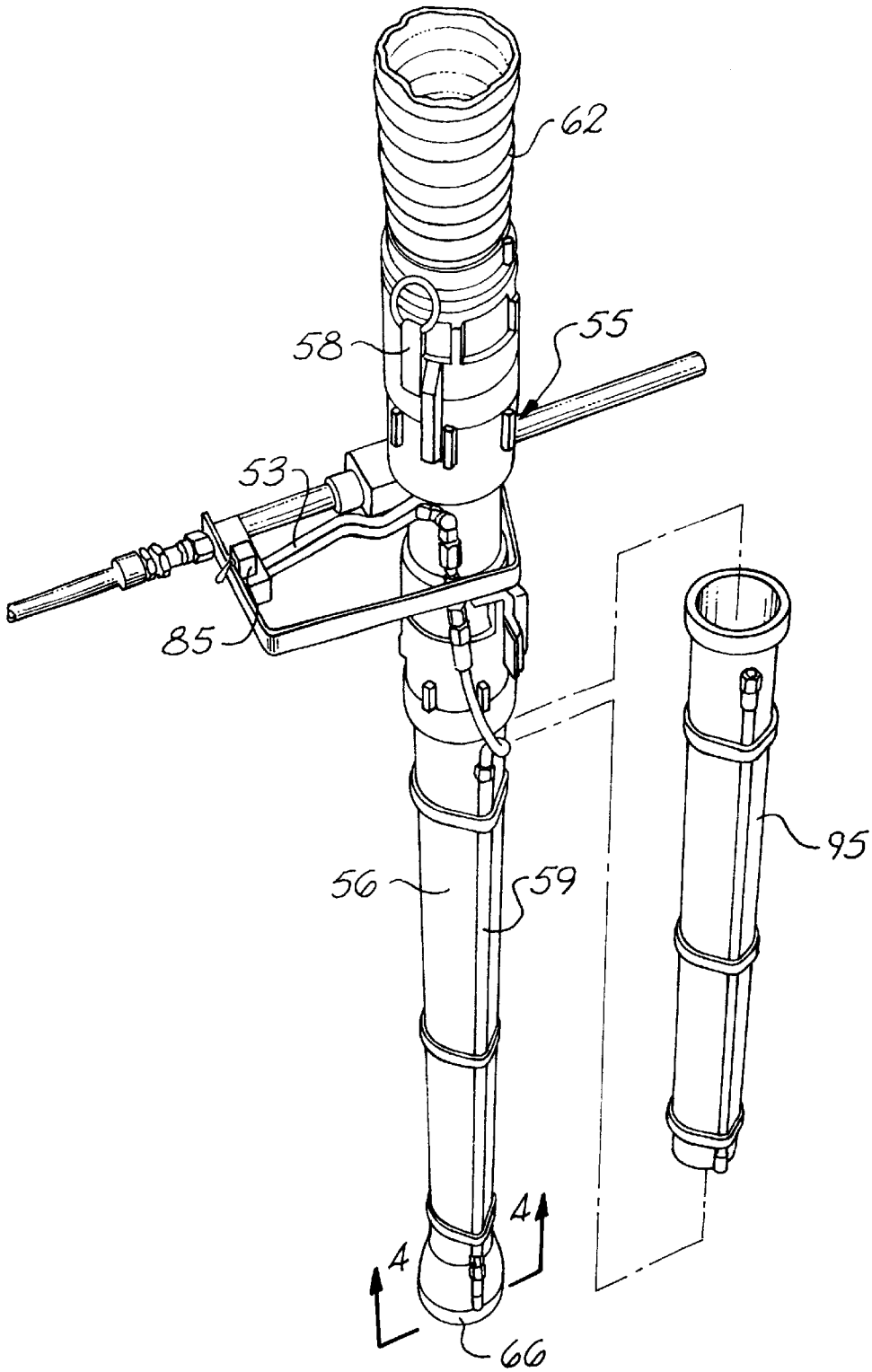
FIG. 3 is a perspective view of a reduction tool constructed in accordance with the present invention.

Trailer T includes four wheels 12 and a draw bar 14 (FIG. 2) and also platform, generally 18, on which reduction system 10 is carried. Water tank W is carried on a forward end of trailer T, and slurry, or spoil, collection tank C is carried on the rear end thereof. Disposed between tanks W and C is motor M, which is preferably gas or diesel engine, although it is to be understood that an electric motor or other motive means could also be used. Preferably, motor M is a thirty horsepower diesel engine, such as manufactured by Kubota (Model No. V1505), or a gas engine such as a Kohler (Model Command PRO CH25S), which is a twenty-five horsepower gasoline engine. Other engines, of course, could be used instead. Motor M drives water pump P via a belt (not shown), and water pump P includes a low pressure inlet side 22 and a high pressure outlet side 24.

Figure 6:
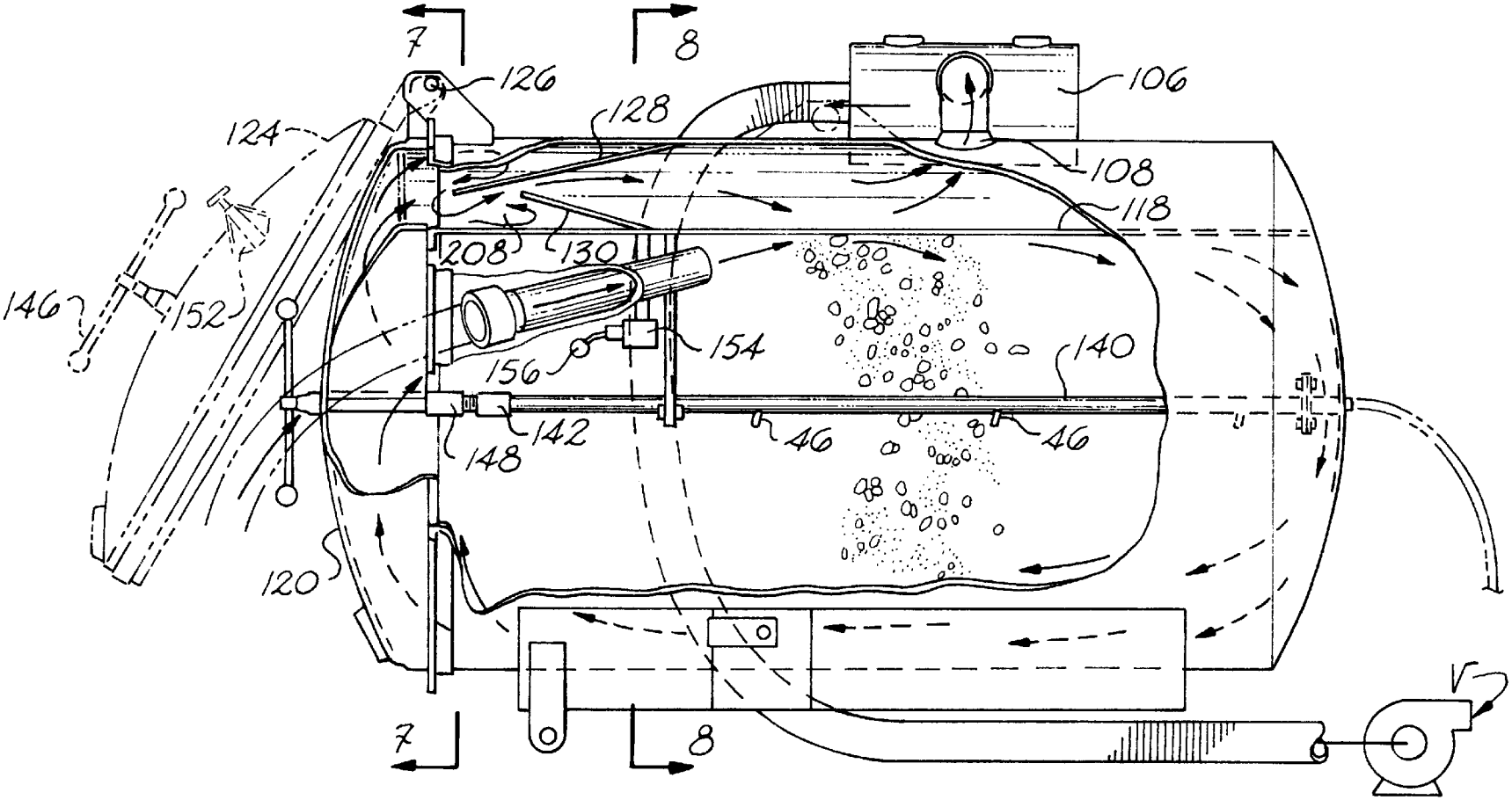
FIG. 6 is a side elevational view of a slurry collection tank used in the reduction system constructed in accordance with the present invention.
Figure 8:
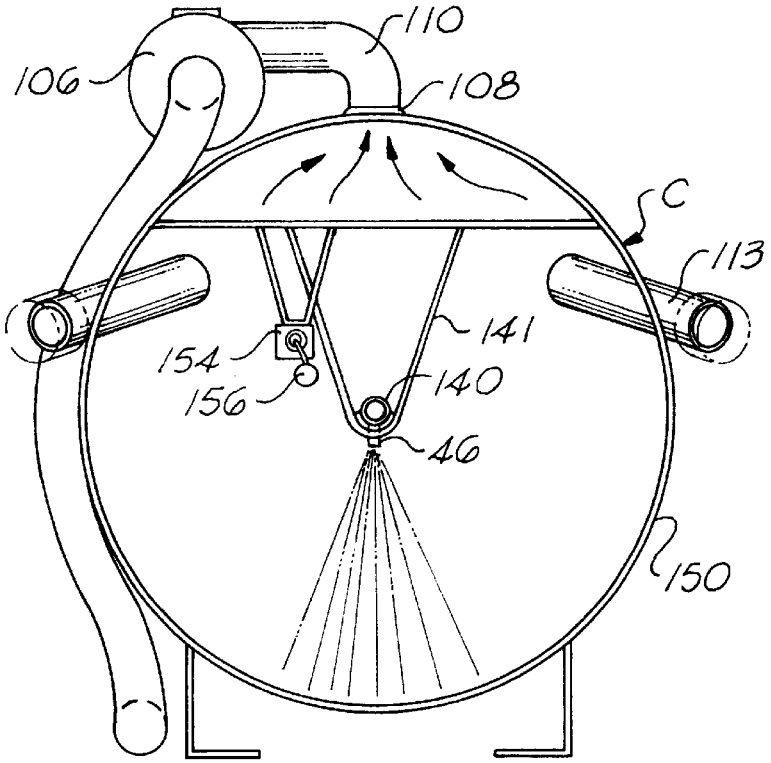
FIG. 8 is sectional elevational view of the slurry collection tank taken along lines 8—8 in FIG. 6.

As shown in FIG. 11, water tank W is connected to the low pressure side of water pump P via a hose 28. Water tank W includes an outlet 30 through which water therefrom first flows through a strainer 32, from a valve 34, then to a check valve 36, and then on through the hose 28 to the low pressure side of water pump P. The high pressure side of water pump P includes a hose 38 connected to a filter 48 then to a pressure relief and bypass valve 42. In line between the high pressure outlet of the water pump and the valve 42 is a tee 44 with valve 45 connecting the high pressure line to clean out nozzles, generally 46, as shown in FIGS. 6, 8, and 11, which will be discussed in more detail below.

The high pressure line then goes to a filter 48 and on to the pressure relief and bypass unloader valve 42 which is preferably a General Pump Model YUZ140. A return line 50 is connected to valve 42 and to water tank W for returning water at a low pressure to tank W when a predetermined pressure is exceeded in the valve 42. This causes water to fully bypass to tank W, or in the event pressurized water, or other fluid as may be needed, is not yet up to a desired pressure, such fluid is returned to the tank W until the predetermined pressure is achieved in the valve 42. A hose 52 is connected to the output of the valve 42 which leads to the reduction tool R. A valve control 53 at the handle, generally 55, of the reduction tool is provided which allows the operator to selectively actuate the valve 53 to deliver water to a conduit 54 (FIGS. 1, 3, 5, and 11) attached to the exterior of an elongated pipe 56 which extends the length of the reduction tool.

The water pump P could be any of a variety of pumps, but preferably delivers between 3,000 and 4,000 pounds per square inch, preferably at a flow rate of approximately four gallons per minute, one suitable pump is manufactured by General Pump (Model No. TS1511).

The reduction tool R includes the handle 55 noted above for grasping by the operator during use of the tool. The handle includes a connector 58 (FIG. 3), such as a "banjo" connector, for connecting a central vacuum passage 60 (FIG. 4), which extends the length of the tool R, to a vacuum source. This is accomplished by attaching one end of vacuum hose 62 to the handle, and the other end of the hose 62 to the collection tank C at a collection tank inlet 64 (FIG. 1). Other connection means could also be used instead of banjo connectors, such as clamps, clips, threaded ends on pipe 56 and handle 55, etc., none of these being shown.

Figure 4:
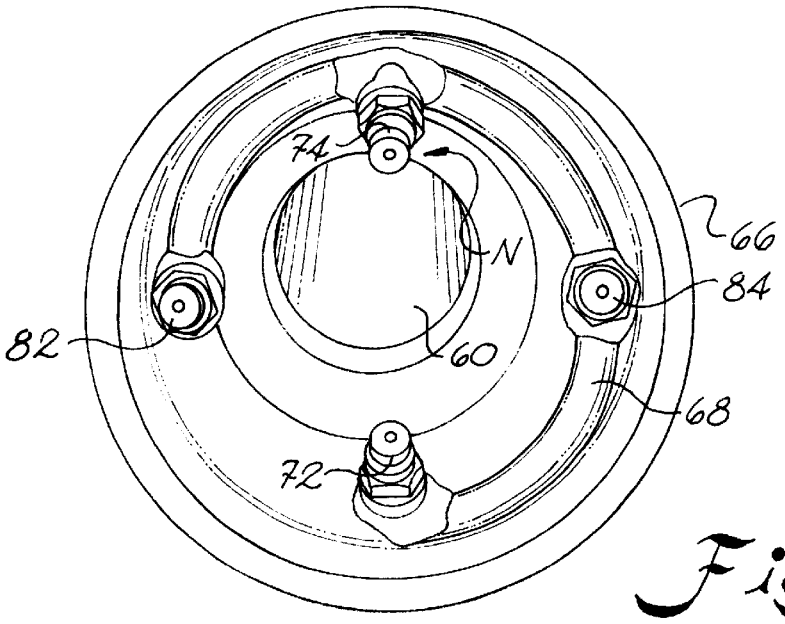
FIG. 4 is a sectional view taken along lines 4—4 of the reduction tool shown in FIG. 3.
Figure 5:
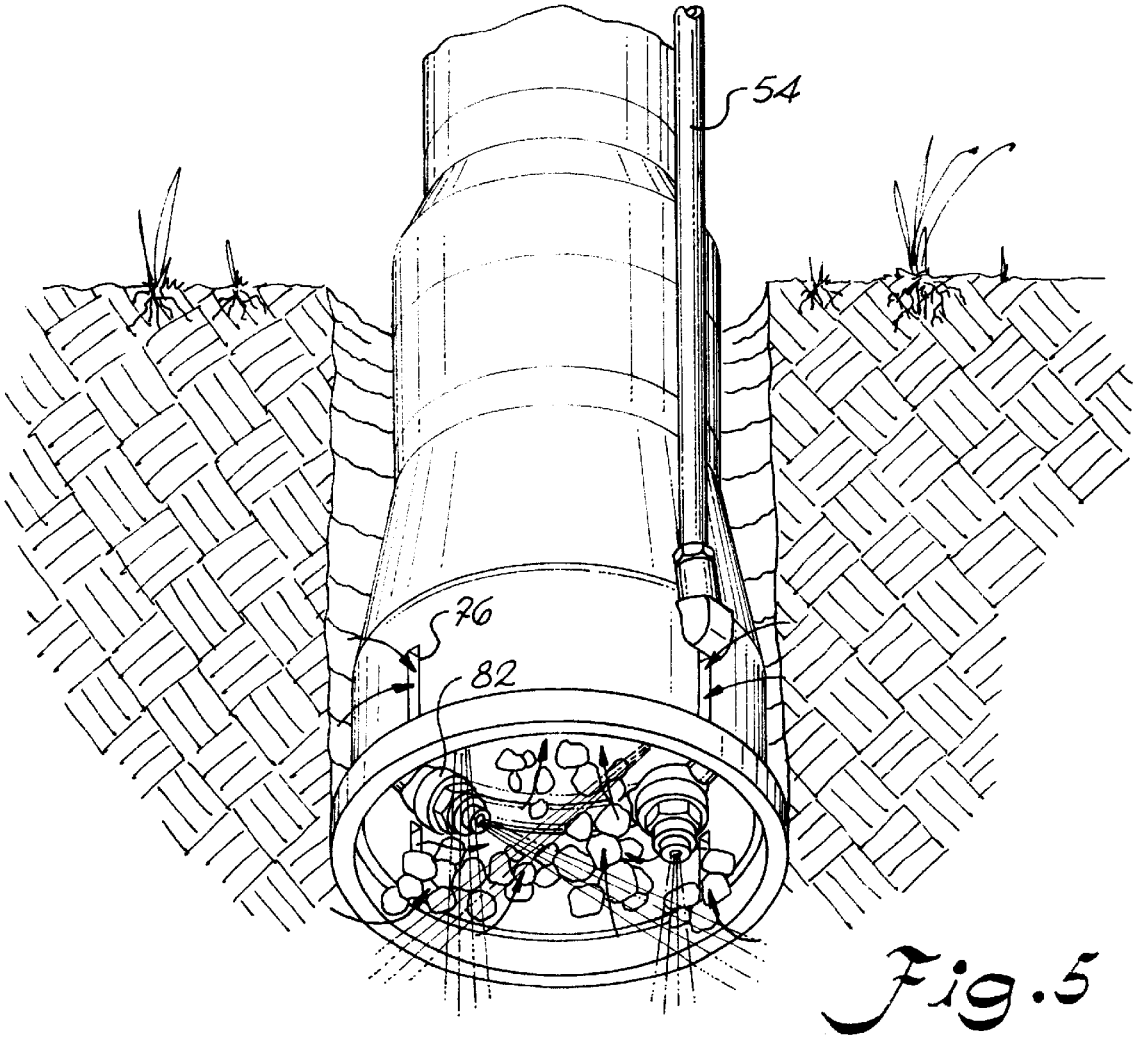
FIG. 5 is a partial perspective view of the reduction tool in use digging a hole.

At the inlet end 66 of the reduction tool, which is opposite the end where the vacuum hose is connected, a fluid manifold 68 (FIG. 4) is provided to which a plurality of nozzles, generally N, are connected. The manifold 68 is connected to the water conduit 54 running the length of the reduction tool. As shown in FIGS. 4 and 5, an important feature of the reduction tool is that the nozzles N are angled with respect to one another. In one preferred embodiment, four such nozzles are used, and two of the nozzles 72, 74 are directed radially inwardly at approximately 45 degrees from vertical. Such an orientation of the nozzles 72, 74 produces a spiral cutting action in the soil as the reduction tool is used. This spiral cutting action breaks the soil up sufficiently to minimize clogging of the soil within the reduction tool vacuum passage and/or the vacuum hose leading to the collection tank C with large chunks of soil.

Another important feature of the reduction tool is provision of a plurality of air inlets 76 in the pipe 56 forming the vacuum passage 60, these inlets 76 allowing air to enter into the vacuum passage adjacent the inlet of the reduction tool. This improves the swirling action of the suction provided by the reduction tool and the speed by which tool R digs, such swirling action being enhanced by the angled placement of the nozzles 72, 74 and contributing to the spiral cutting action of the reduction tool as it is used.

The downward cutting action of the reduction tool is also enhanced by the two nozzles 82, 84 which generally point vertically downwardly and which, in combination with the other two angled nozzles 72, 74, allow for soil to be removed not only above a buried utility, but in certain cases, allows for soil to be removed from around the entire periphery of a buried cable or pipe. In other words, the soil is removed above such utility, from around the sides of the utility, and beneath the utility. This can be useful for further verifying the precise utility, and also, if necessary to make repairs or to tie into such utility.

Reduction tool R could include an additional control for controlling the vacuum feature of the tool. This could allow remote control 85 of the vacuum system, and could comprise an electrical switch and/or a vacuum or pneumatic switch, or perhaps, a wireless switch to control the vacuum action by allowing the vacuum to be shut off, or otherwise modulated from the handle above the reduction tool.

A wireless remote control system 88 for controlling the idle speed of motor M is also part of the invention. As shown in FIG. 11, the speed of motor M can be varied between high and low by a keypad transmitter 90, which transmits motor speed control to receiver 92 connected to the throttle of motor M.

Figure 12:
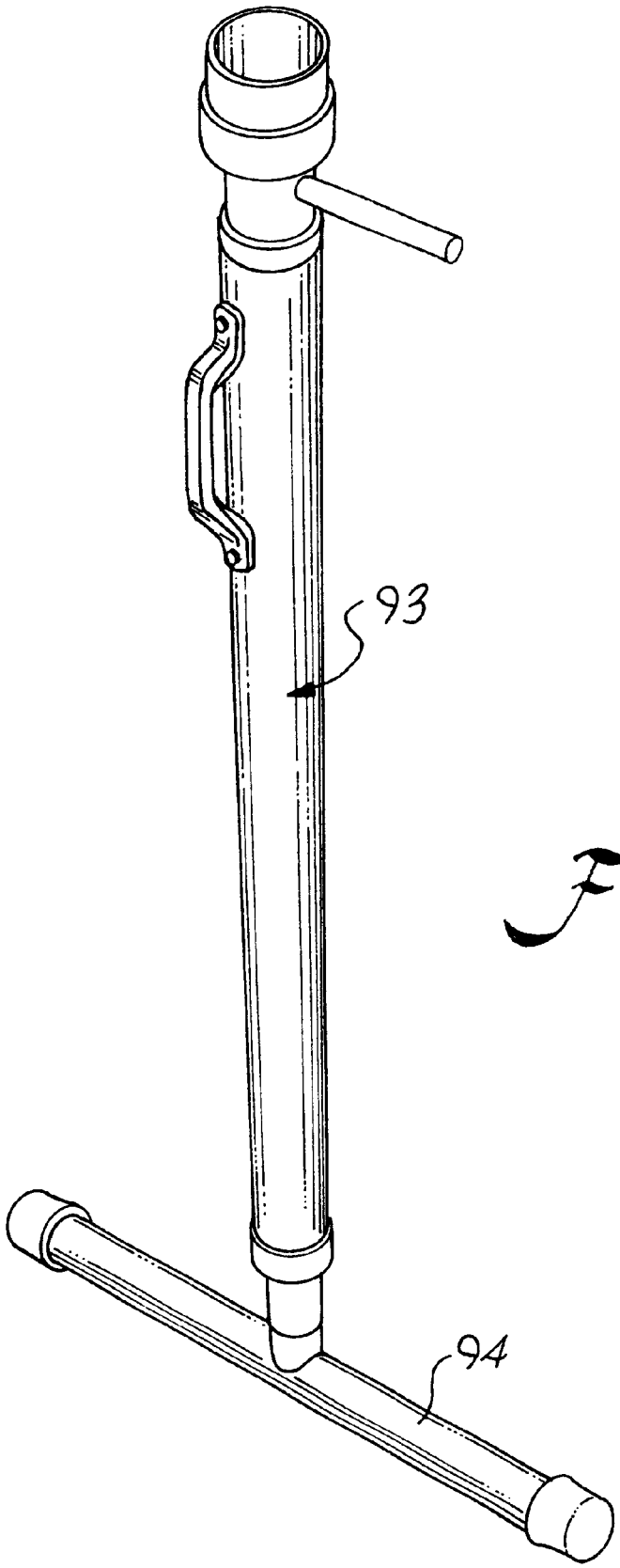
FIG. 12 is a perspective view of an alternate embodiment of a reduction tool constructed in accordance with the present invention having a vacuum head.

As shown in FIG. 12, reduction tool R may also include attachments, such as a vacuum device 93 having a slotted vacuum head 94 for allowing removal of drilling mud and non-hazardous fluid from the ground surface. Additionally, the effective length of the reduction tool R can be readily extended by adding additional sections of pipe 95. These sections are connected to the handle portion with use of releasable clips, such as banjo clips 98 (FIG. 8), or through a threaded connection, clamps, or some other suitable connection means (not shown).

Turning now to FIGS. 6 and 11, the vacuum system of the present invention includes a vacuum pump V, preferably a positive displacement type such as the type used as a supercharger on diesel trucks. One such pump is a Tuthill blower (Model 4009-46R3). The vacuum pump is preferably driven by the motor M by a belt (not shown), and the intake 102 of the vacuum pump preferably leads to a vacuum relief device 104, such as a Kunkle valve (Model 215V-H01AQE), which controls the maximum negative pressure of vacuum to be pulled by the pump. The negative pressure range is preferably between ten inches and fifteen inches of Hg. Downstream of the pressure relief valve is a filter 106, which can be a paper filter such as a Fleet Guard brand filter, and then downstream from the filter 106, the vacuum is connected to the exhaust outlet 108 of the collection tank, as shown in FIGS. 1, 2, 6, 8 and 11. The exhaust side of the vacuum pump includes a conduit 110 leading to a silencer 112, such as manufactured by Phillips and Timroe Industries. From the silencer 112, the exhaust is vented to atmosphere.

The vacuum provided by the vacuum pump produces a vacuum in the collection tank, which in turn draws a vacuum through the inlet 113 of collection tank. When not closed by a plug 114, the inlet may be hooked up to the hose 62 leading to the reduction tool R for drawing vacuum through the reduction tool together with soil and water produced from digging a hole, such as in a slurry mixture, or water and/or drilling mud, bentonite, or other materials to be vacuumed.

Figure 7:
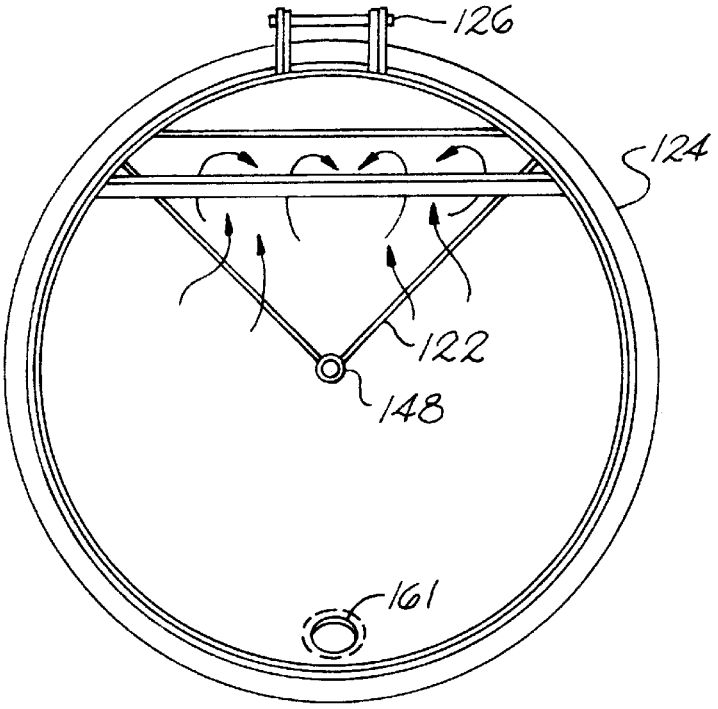
FIG. 7 is sectional view of a door for the slurry collection tank taken along lines 7—7 in FIG. 6.

Since it would be undesirable to draw dirt or other particular matter into the vacuum pump, a baffle system is provided within collection tank C to separate soil and other material from the soil, water, and other material from the vacuum air flow received from the reduction tool. As shown in FIG. 6, air drawn in through the inlet 113 of the collection tank is first drawn upwardly, and dirt, rocks, and other debris in the flow hit a baffle 118 and expend energy, thereby falling to the bottom portion of the collection tank. Smaller particles continue to be carried by the flow towards the front of the tank, and downwardly across the bottom of the tank back towards the rear 120 of the tank. Debris that does not fall out by this point may be carried upwardly, but may also impact a V-shaped baffle 122 (FIG. 7), provided on the discharge door 124 of the tank. The discharge door 124 is hinged to the top of the tank by a hinge 126 and swings open to allow cleaning the tank, as will be discussed in more detail below.

The vacuum air stream, after contacting the V-shaped baffle 122 continues upwardly and impacts and is deflected by an upper baffle 128 and then further impacts and is further deflected by a second upper baffle 130, each time causing additional particles or other materials constrained in the air flow to become trapped at these baffles. Finally, the vacuum air flow exits the outlet 108 of the collection tank and passes through the filter 106 and on to the vacuum pump, as discussed above.

Collection tank C includes means for emptying its contents. Hydraulic cylinders 132 (FIG. 2) are provided for tilting the forward end 134 of the tank upwardly in order to cause the contents to run towards the back door 124. After opening of the back door, the contents may then be discharged therefrom.

A problem may arise, however, in cleaning out the solids deposited in the base of collection tank C. Prior systems have required manual cleaning of the tank with tools and/or a water hose, and the present invention includes an important automatic tank cleaning feature. Running the length of the tank C is a nozzle tube 140 supported by hanger 141 (FIG. 8) which includes a plurality of fan-shaped nozzles 46 for directing high pressure water about the tank, and particularly towards the base of the tank. These nozzles 46 are actuated by turning the valve 45, which causes high pressure water delivered by the water pump to be delivered to the nozzles for producing a vigorous cleaning action to the tank. Preferably, even when the nozzles 46 are not being used for cleaning, a small amount of water is allowed to continuously drip through the nozzles to pressurize them in order to prevent dirt and slurry delivered to the tank during the reduction operation from entering and clogging the nozzles.

Although not shown, the nozzles could be provided with check valves to prevent the soil/water mixture, or slurry, from entering the nozzles during transport of device 10 or the vacuuming operation to thereby prevent clogging thereof. Or, it is anticipated that "gland" type nozzles could also be used which seal themselves when not in use. This, again, prevents or minimizes clogging of the nozzles. Additionally, mechanical flappers (not shown) could be used to cover the exit of the nozzles when not in use, the flappers being blown to the side out of the way by the force of the nozzles when actuated.

The nozzle tube 140, apart from being a conduit for delivering water to the high pressure nozzles used for cleaning tank C, is also a structural member. The nozzle tube includes a threaded male portion 142 (FIG. 6) on the end thereof adjacent the back door 124 of the collection tank. When the door is to be shut, and the collection tank sealed, a screw-down type handle 146 mounted in the door is turned, and the screw-down handle includes an outwardly projecting threaded female portion 148 (FIG. 6) which mates with the male portion as the handle is turned, thus tightly pulling the door to the open rim 150 of the collection tank, thereby sealing the tank. Actuation of the vacuum pump further assists the sealing of the door against the tank opening. Note the door also includes a sight glass 152 to allow for visual observation of the interior of the tank.

Another feature of the present invention is the automatic shutoff system provided within the collection tank. A float switch 154 (FIG. 8) is provided in the tank connected to a float 156. This float switch normally hangs downwardly until the level of slurry in the tank rises to a level which causes the float switch to begin to float and move upwardly. Once the float switch moves upwardly by a predetermined amount, it causes, through action of the rod connected to the float switch, float switch 154 to activate to shut off the vacuum system. This prevents the slurry level from becoming so high that it is actually drawn upwardly through the outlet of the tank and into the vacuum pump.

Although not shown, instead of or in addition to the nozzle tank cleaning system discussed above, the collection tank could be provided with a hydrostatic perforated plate on the bottom of the tank. This plate would include numerous holes through which fluid or air could be pumped upwardly. This upward pressurized flow could be used to lift sediment from the bottom of the tank, and as the tank is tilted upwardly during the cleaning operation, it is anticipated that such hydrostatic pressure could be used to loosen up and perhaps levitate the sediment for dumping from the tank.

The door to the collection tank also includes a gate valve 160 for draining the liquid portion of the slurry through a drain 161 in the back door 124, without requiring the door 124 to be open. The gate valve may also be used to introduce air into the tank in order to reduce the vacuum within the tank by a sufficient degree such that the door may be opened.

The hydraulic cylinders 132 used to tilt the tank are powered by an electric hydraulic motor, generally H (FIG. 11), having a hydraulic reservoir 164, the motor being driven by the electrical system of the motor M. An additional hydraulic pump 168 can be mechanically mounted to the motor M to be driven by motor M. As shown in FIG. 11, the hydraulic pump 168 includes its own hydraulic reservoir 170 and can be a conventional tractor hydraulic pump such as manufactured by Kubota. The output high pressure line of the hydraulic pump, which preferably delivers between 5.8 and 6 gallons per minute, is connected to a pressure relief valve 171 and also a control valve 172 for controlling flow of hydraulic fluid through the line. A pressure gauge 174 may also be provided between the pressure relief valve and the control valve. Control valve 172 includes a knob (not shown) for activating same. From the control valve, a line leads to a quick disconnect coupling 178 (FIGS. 1 and 2), which is mounted within the frame of the trailer. This quick disconnect provides a high pressure source of hydraulic fluid for powering auxiliary tools, such as perhaps pavement saws, breakers, or other devices which may be used in connection with a reduction system 10. A hydraulic return line 180 is also provided on the trailer, and downstream of the return line inlet is a filter 182 which filters the hydraulic fluid before returning it to the hydraulic reservoir.

Figure 9:
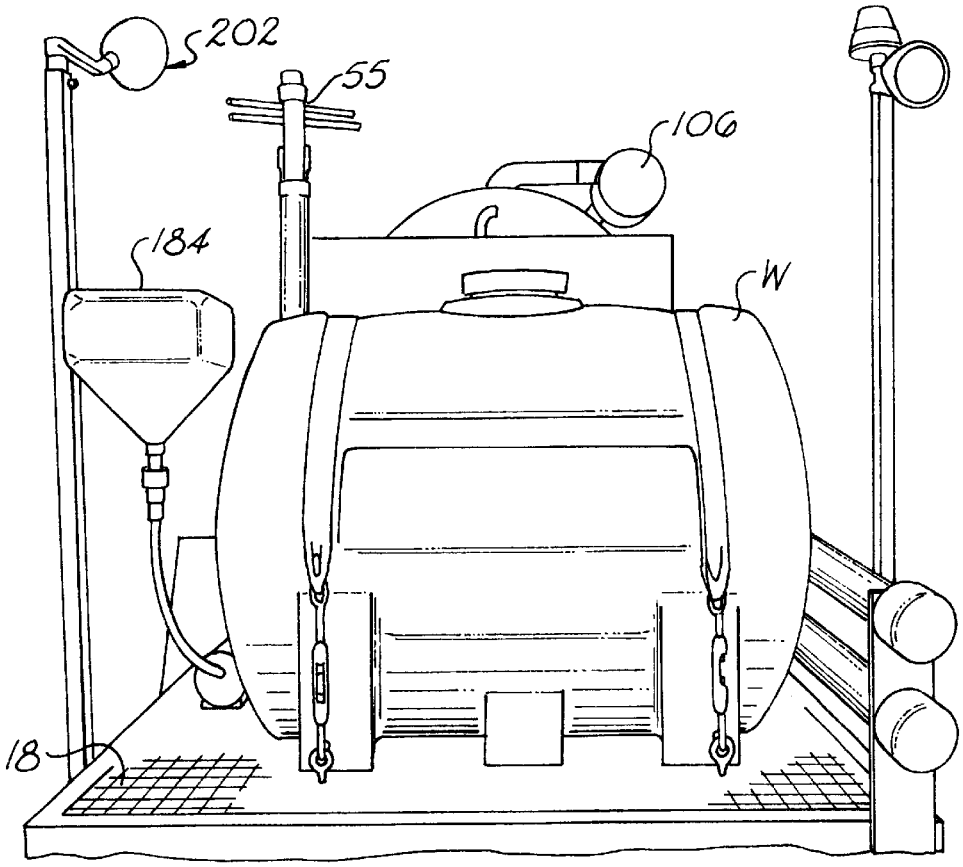
FIG. 9 is an end view of the reduction system, showing a water supply tank constructed in accordance with the present invention.
Figure 10:
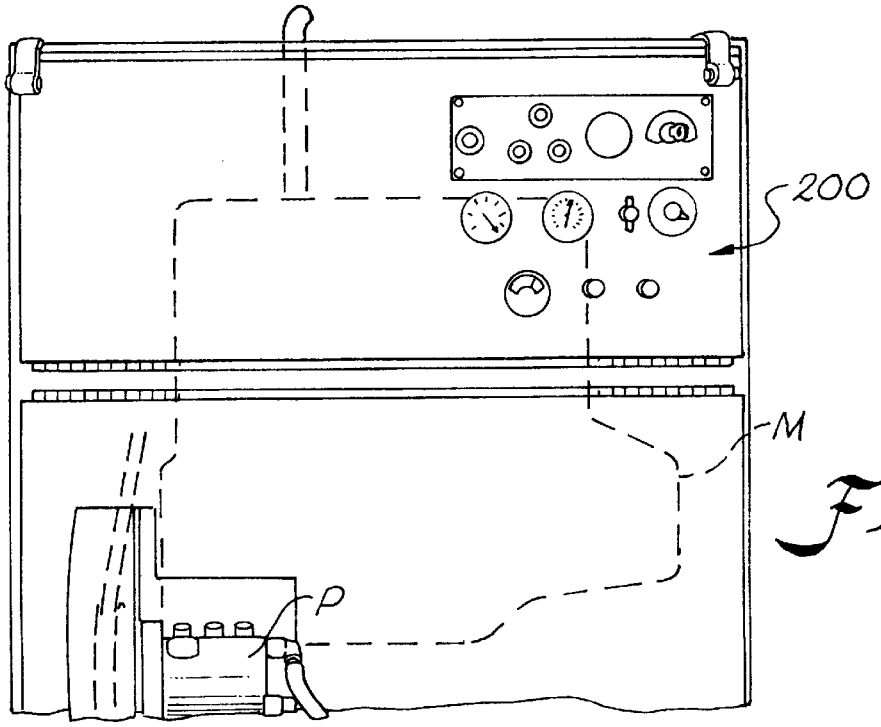
FIG. 10 is a partial side elevational view of drive means for the reduction system.

An antifreeze system, generally 184 (FIGS. 1 and 9), is provided for preventing freezing of the water pump and water system. When the pump is to be left unused in cold weather, the pump may be used to draw antifreeze from the reservoir. Preferably, such antifreeze is nontoxic, and environmentally friendly.

To use reduction system 10, water is added to water tank W, and the valve 34 is opened to allow water flow to the water pump. The motor M is powered up, and water pressure is allowed to build in the system. The reduction tool R is connected to the collection tank C with the vacuum hose 62, and water line 184 is also connected to the reduction tool. A hose reel 188 is provided for paying out water line 184 to the reduction tool during use.

As the tool R is used, it is pressed downwardly into the ground in order to dig a hole. For larger diameter holes, the tool R is moved in a generally circular manner as it is pressed downwardly. Slurry will begin to accumulate in the collection tank C as the tool R is used. Once the job is finished, or when the collection tank is full, the engine is set to a low idle to maintain a vacuum in the tank. This allows the door handle to be turned such that the female threaded member is no longer in threading engagement with the male member, the vacuum pressure continuing to hold the door closed. The engine can then be shut down and then air enters the tank through the vacuum pump or other openings, thereby pressurizing the tank and allowing the door to be opened.

In certain situations, for example in rescue work or for transporting loose material (such as sand, snow, or grain), tool R can be used without the nozzles N being activated. Operation of tool R would be similar as with normal excavation, with tool R being pressed downwardly in the material to be removed by the operator.

The present invention also includes a vacuum pressure switch and relay (not shown) provided in connection with the tank C which senses the vacuum in tank C, and which prevents tank C from being raised for dumping purposes until the vacuum has dropped low enough in the tank for the door 124 to be opened. Once the vacuum in the tank has diminished to the point that door 124 may be opened, tank C may be elevated for dumping purposes. This prevents slurry contained in tank C from being pushed up into filter 106 should door 124 be open, if a vacuum were still present in tank C, and in particular, in the upper baffled chamber, generally 208, of tank C.

A control panel 200 provides vacuum and water pressure readouts and also controls for motor M. Also, lights 202 are provided on system 10 for allowing use at night or in low light conditions. An auxiliary spray wand 204 is provided which can be attached to high pressure water line 184 for allowing localized cleaning of tank C or other items.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the following claims.

What is claimed is:

1. A reduction system for moving and collecting material, the reduction system comprising:

a collection tank for receipt and accumulation of the material;

an elongated reduction toot connected to said collection tank for lifting and removing the material from a location; said elongated reduction tool defining a free end and an elongated transport passage extending therethrough for transporting the material; and said reduction tool having a peripheral wall defining an inlet at said free end; said inlet being in fluid communication with said elongated transport passage;

a source of pressurized liquid, said source of pressurized liquid being connected to said reduction tool for delivering a pressurized liquid flow to said reduction tool for direction by said reduction tool against the material for loosening the material;

a plurality of nozzles in said transport passage adjacent said inlet for directing the pressurized liquid towards the material, at least one of said nozzles being configured for emitting the pressurized liquid generally parallel to said transport passage towards said inlet, and at least one of said nozzles being angled inwardly and configured for emitting the pressurized liquid towards said transport passage; and a source of vacuum connected to said reduction tool and to said collection tank, said source of vacuum creating and drawing a vacuum flow through said collection tank and said reduction tool for pulling the material through said reduction tool and into said collection tank.

2. A reduction system as defined in claim 1, wherein said source of pressurized liquid includes a liquid reservoir and a liquid pump for delivering said pressurized liquid flow and further comprising a sensor connected to said liquid reservoir for detecting when the liquid in said liquid reservoir reaches a predetermined level.

3. A reduction system as defined in claim 1, wherein said reduction tool includes at least two of said nozzles being configured for emitting the pressurized liquid generally parallel to said transport passage and at least two of said nozzles being angled inwardly and configured for emitting the pressurized liquid towards said transport passage.

4. A reduction system as defined in claim 1, wherein said reduction tool includes at least two of said nozzles being generally opposite from one another and configured for emitting the pressurized liquid generally parallel to said transport passage and at least two of said nozzles being generally opposite from one another and angled inwardly at approximately 45 degrees with respect to said transport passage and configured for emitting the pressurized liquid towards said transport passage.

5. A reduction system as defined in claim 1, wherein said reduction tool includes a manifold in said inlet portion and said plurality of nozzles connected to said manifold for directing the pressurized liquid towards the material.

6. A reduction system as defined in claim 1, wherein said reduction tool includes a generally semi-circular manifold in said inlet portion and said plurality of nozzles connected to said manifold for directing the pressurized liquid towards the material.

7. A reduction system as defined in claim 1, wherein said peripheral wall defines at least one air intake slot adjacent said inlet.

8. A reduction system as defined in claim 1, wherein said reduction tool includes a single conduit for receipt of the pressurized liquid used by the reduction tool.

9. A reduction system as defined in claim 1, wherein said reduction tool includes a single conduit for receipt of the pressurized liquid used by the reduction tool, said single conduit being connected to an exterior portion of said reduction tool.

10. A reduction system as defined in claim 1, wherein said reduction tool includes at least one coupling and an elongated extension portion attached to said reduction tool with said coupling for increasing the length of said reduction tool.

11. A reduction system as defined in claim 1, wherein said reduction tool includes at least one coupling and a rigid elongated extension portion, said extension portion defining a second internal elongated transport passage, said extension portion configured to be attachable to said reduction tool with said coupling for increasing the length of said reduction tool.

12. A reduction system as defined in claim 1, wherein said reduction tool includes at least one banjo coupling and an elongated extension portion attached to said reduction tool with said banjo coupling for increasing the length of said reduction tool.

13. A reduction system as defined in claim 1, further comprising a control connected to said reduction tool for controlling said vacuum flow.

14. A reduction system as defined in claim 1, further comprising a control connected to said reduction tool for controlling said pressurized fluid flow.

15. A reduction system as defined in claim 1, wherein said source of vacuum is a vacuum pump.

16. A reduction system as defined in claim 1, wherein said source of vacuum is a vacuum pump and further comprising a control connected to said reduction tool for controlling said vacuum pump.

17. A reduction system as defined in claim 1, wherein said source of pressurized liquid includes a fluid reservoir and a fluid pump for delivering said pressurized liquid flow.

18. A reduction system as defined in claim 1, wherein said source of pressurized liquid includes a liquid reservoir and a liquid pump for delivering said pressurized liquid flow and further comprising a control connected to said reduction tool for controlling said liquid pump.

19. A reduction system as defined in claim 1, wherein:

said source of vacuum is a vacuum pump;

said source of pressurized liquid includes a liquid reservoir and a liquid pump for delivering said pressurized liquid flow;

and further comprising:

a motor connected to said vacuum pump and to said liquid pump for driving said vacuum pump and said liquid pump; and a control connected to said reduction tool for controlling said motor.

20. A reduction system as defined in claim 1, further comprising a wireless remote control connected to said reduction tool for controlling said vacuum flow.

21. A reduction system as defined in claim 1, further comprising a wireless remote control connected to said reduction tool for controlling said pressurized liquid flow.

22. A reduction system as defined in claim 1, further comprising a wireless remote control connected to said reduction tool for controlling said pressurized liquid flow and said liquid flow.

23. A reduction system as defined in claim 1, further comprising a control connected to said reduction tool for controlling said pressurized liquid flow and said vacuum flow.

24. A reduction system for moving and collecting material, the reduction system comprising:

a collection tank for receipt and accumulation of the material;

an elongated reduction tool connected to said collection tank for lifting and removing the material from a location; said elongated reduction tool defining a free end and an elongated transport passage extending therethrough for transporting the material; and said reduction tool having a peripheral wall defining an inlet at said free end; said inlet being in fluid communication with said elongated transport passage;

a source of pressurized liquid, said source of pressurized liquid being connected to said reduction tool for delivering a pressurized liquid flow to said reduction tool for direction by said reduction tool against the material for loosening the material;

at least one nozzle in said transport passage adjacent said inlet for directing the pressurized liquid towards the material;

said peripheral wall defining at least one air intake opening for allowing air to enter said transport passage;

a conduit carried on the exterior of said reduction tool and connected to said manifold for delivering pressurized liquid to said nozzle;

a source of vacuum connected to said reduction tool and to said collection tank, said source of vacuum creating and drawing a vacuum flow through said collection tank and said reduction tool for pulling the material through said reduction tool and into said collection tank; and a control carried by said reduction tool for controlling said pressurized liquid flow and said vacuum flow.

25. A reduction system for moving material, the reduction system comprising:

an elongated reduction tool for lifting and removing the material from a location; said elongated reduction tool defining an elongated transport passage extending therethrough for transporting the material and a free end; and said reduction tool having a peripheral wall defining an inlet at said free end; said inlet being in fluid communication with said elongated transport passage;

a source of pressurized liquid, said source of pressurized liquid being connected to said reduction tool for delivering a pressurized liquid flow to said reduction tool for direction by said reduction tool against the material for loosening the material;

said source of pressurized liquid including a liquid reservoir and a liquid pump for delivering said pressurized liquid flow;

a sensor connected to said liquid reservoir for detecting when the liquid in said liquid reservoir reaches a predetermined level;

a plurality of nozzles in said transport passage adjacent said inlet for directing the pressurized liquid towards the material, at least one of said nozzles being configured for emitting the pressurized liquid generally parallel to said transport passage towards said inlet, and at least one of said nozzles being angled inwardly towards said transport passage; and a source of vacuum connected to said reduction tool, said source of vacuum creating and drawing a vacuum flow through said reduction tool for pulling the material through said reduction tool.

26. A reduction system for moving material, the reduction system comprising:

an elongated reduction tool for lifting and removing the material from a location; said reduction tool defining an elongated transport passage extending therethrough for transporting the material and a free end; and said reduction tool having a peripheral wall defining an inlet at said free end; said inlet being in fluid communication with said elongated transport passage;

a plurality of nozzles in said transport passage adjacent said inlet for directing the pressurized liquid towards the material, at least one of said nozzles being configured for emitting the pressurized liquid generally parallel to said transport passage towards said inlet, and at least one of said nozzles being angled inwardly towards said transport passage;

a source of pressurized liquid, said source of pressurized liquid being connected to said reduction tool for delivering a pressurized liquid flow to said reduction tool for direction by said reduction tool against the material for loosening the material; and a source of vacuum connected to said reduction tool, said source of vacuum creating and drawing a vacuum flow through said reduction tool for pulling the material through said reduction tool.

27. A reduction tool for transporting material, the reduction tool being for use in a reduction system having pressurized liquid, the reduction tool comprising:

an elongated transport portion having a handle connected thereto, said reduction tool defining an elongated transport passage extending therethrough for transporting the material and a free end; and said reduction tool having a peripheral wall defining an inlet at said free end; said inlet being in fluid communication with said elongated transport passage; and a plurality of nozzles in said transport passage adjacent said inlet for directing the pressurized liquid towards the material, at least one of said nozzles being configured for emitting the pressurized liquid generally parallel to said transport passage towards said inlet, and at least one of said nozzles being angled inwardly towards said transport passage.

28. The reduction tool as defined in claim 27, further comprising a manifold adjacent said transport passage and said plurality of nozzles connected to said manifold for directing the pressurized liquid towards the material.

29. The reduction tool as defined in claim 27, further comprising a generally semi-circular manifold in said transport passage adjacent said inlet and at least two of said plurality of nozzles connected to said manifold for directing the pressurized liquid towards the material.

30. The reduction tool as defined in claim 27, wherein said peripheral wall defines a plurality of air intake openings adjacent said inlet.

31. A method for moving and collecting material, the method comprising:

providing a collection tank for receipt and accumulation of the material;

providing a reduction tool for lifting and removing the material from a location;

connecting said reduction tool to said collection tank;

providing a source of pressurized fluid for delivering a pressurized fluid flow to said reduction tool;

connecting said source of pressurized fluid to said reduction tool;

providing a source of vacuum;

connecting said reduction tool and said collection tank to said source of vacuum;

directing said pressurized fluid flow with said reduction tool against the material and delivering a generally helical cutting action with said pressurized fluid flow for loosening the material; and drawing a vacuum flow through said collection tank and said reduction tool with said source of vacuum for pulling the material through said reduction tool and into said collection tank.

32. A reduction system for moving material, the reduction system comprising:

a collection tank for receipt and accumulation of the material;

an elongated reduction tool connected to said collection tank for lifting and removing the material from a location, said reduction tool having a generally transversely extending head portion, said head portion having an elongated slotted portion for receiving the material; said reduction tool defining an elongated transport passage and a free end; and said reduction tool having a peripheral wall defining an inlet at said free end; said inlet being in fluid communication with said elongated transport passage;

a source of pressurized fluid including a fluid reservoir and a fluid pump for selectively delivering a pressurized fluid flow to said collection tank;

a plurality of nozzles connected to said transport passage adjacent said inlet for directing the pressurized liquid towards the material, at least one of said nozzles being configured for emitting the pressurized liquid generally parallel to said transport passage towards said inlet, and at least one of said nozzles being angled inwardly towards said transport passage and a source of vacuum connected to said reduction tool, said source of vacuum creating and drawing a vacuum flow through said slotted portion of said reduction tool for pulling the material through said reduction tool and into said collection tank.

33. The reduction tool as defined in claim 32 wherein said transversely extending head portion is generally cylindrical in shape.

34. A reduction tool for transporting material, the reduction tool being for use in a reduction system having pressurized fluid, the reduction tool comprising:

an elongated body portion defining an elongated transport passage extending therethrough for transporting the material; and means connected to said elongated body portion for forming generally helical cuts in the material by directing the pressurized fluid towards the material, said means directing the pressurized fluid in a first direction in general alignment with said transport passage, in a second direction angled inwardly towards said transport passage, and in a third direction generally opposed to said second direction and angled inwardly towards said transport passage.

35. A reduction tool for transporting material, the reduction tool being for use in a reduction system having pressurized fluid, the reduction tool comprising:

an elongated body portion defining an elongated transport passage extending therethrough for transporting the material and a free end; and said reduction tool having a peripheral wall defining an inlet at said free end; said inlet being in fluid communication with said elongated transport passage; and a plurality of nozzles connected to said transport passage adjacent said inlet for directing the pressurized liquid towards the material, at least one of said nozzles being configured for emitting the pressurized liquid generally parallel to said transport passage towards said inlet, and at least one of said nozzles being angled inwardly towards said transport passage.

36. A reduction tool for transporting material, the reduction tool being for use in a reduction system having pressurized liquid, the reduction tool comprising:

an elongated body portion defining an elongated transport passage extending therethrough for transporting the material and a free end; and said reduction tool having a peripheral wall defining an inlet at said free end; said inlet being in fluid communication with said elongated transport passage; and a plurality of nozzles in said transport passage adjacent said inlet for directing the pressurized liquid towards the material, at least one of said nozzles being configured for emitting the pressurized liquid generally parallel to said transport passage towards said inlet, and at least one of said nozzles being angled inwardly towards said transport passage.

37. A reduction system for moving and collecting material, the reduction system comprising:

a collection tank for receipt and accumulation of the material;

an elongated reduction tool connected to said collection tank for lifting and removing the material from a location; said elongated reduction tool defining a free end and an elongated transport passage extending therethrough for transporting the material; and said reduction tool having a peripheral wall defining an inlet at said free end; said inlet being in fluid communication with said elongated transport passage;

a source of pressurized liquid, said source of pressurized liquid being connected to said reduction tool for delivering a pressurized liquid flow to said reduction tool for direction by said reduction tool against the material for loosening the material;

a plurality of nozzles in said transport passage adjacent said inlet for directing the pressurized liquid towards the material, at least two of said nozzles being generally opposite from on another and configured for emitting the pressurized liquid generally parallel to said transport passage towards said inlet, and at least two of said nozzles being generally opposite one another and angled inwardly and configured for emitting the pressurized liquid towards said transport passage;

a manifold in said transport passage adjacent said inlet, said plurality of nozzles being in fluid communication with said manifold;

said peripheral wall defining at least one air intake opening for allowing air to enter said transport passage;

a conduit carried on the exterior of said reduction tool and connected to said manifold for delivering pressurized liquid to said plurality of nozzles;

a source of vacuum connected to said reduction tool and to said collection tank, said source of vacuum creating and drawing a vacuum flow through said collection tank and said reduction tool for pulling the material through said reduction tool and into said collection tank; and a control carried by said reduction tool for controlling said pressurized liquid flow and said vacuum flow.

38. The reduction system as defined in claim 37, wherein said reduction tool defines a first internal elongated transport passage for transporting the material and further comprising at least one coupling and a rigid elongated extension portion, said extension portion defining a second internal elongated transport passage, said extension portion configured to be attachable to said reduction tool with said coupling for increasing the length of said reduction tool.

* * * * *

UNITED STATES PATENT AND TRADEMARK OFFICE

CERTIFICATE OF CORRECTION

PATENT NO. : 6,470,605 B1
DATED : October 29, 2002
INVENTOR(S) : John William Gilman It is certified that error appears in the above-identified patent and that said Letters Patent is hereby corrected as shown below:

Column 10,
Line 17, “toot” should read -- tool --

Column 15,
Line 30, “a plurality of nozzles in said transport passage” should read -- a plurality of nozzles connected to said transport passage --

Column 16,
Line 13, “opposite from on another” should read -- opposite from one another --.

Signed and Sealed this

Twenty-fifth Day of February, 2003

JAMES E. ROGAN
*Director of the United States Patent and Trademark Office*